United States Patent [19]

Katz et al.

[11] 3,968,927

[45] July 13, 1976

[54] MAIL ORDER ENVELOPE ASSEMBLY

[76] Inventors: Robert E. Katz, 17 Camelot Drive, Livingston, N.J. 07039; Leo Zern, 48 Old Field Lane, Great Neck, N.Y. 11020

[22] Filed: Mar. 5, 1975

[21] Appl. No.: 555,340

[52] U.S. Cl. ..... 229/70

[51] Int. Cl.[2] ..... B65D 27/00

[58] Field of Search ..... 229/70

[56] References Cited

UNITED STATES PATENTS

| | | | |
|---|---|---|---|
| 1,677,022 | 7/1928 | Deutschmeister | 229/70 X |
| 2,347,075 | 4/1944 | Berkowitz | 229/70 |
| 3,302,861 | 2/1967 | Hiersteiner | 229/70 |
| 3,334,806 | 8/1967 | Hiersteiner | 229/70 |
| 3,356,286 | 12/1967 | Greason | 229/70 |
| 3,472,444 | 10/1969 | Aliff, Jr. et al. | 229/70 |
| 3,817,445 | 6/1974 | Greason | 229/70 |

*Primary Examiner*—Stephen P. Garbe
*Attorney, Agent, or Firm*—Shlesinger, Arkwright, Garvey & Dinsmore

[57] ABSTRACT

A preprinted mail order assembly for mass distribution includes an evelope with a tear-off order blank and a tear-off shipping label. The elements are arranged to permit both outer panels to be fully devoted to advertising, while both interior panels carry the required information and address sections. There are three overlapping sections made from a single web in which two longitudinal fold lines constitute the side edges of the envelope with a longitudinal securing strip adjacent one of the fold lines. Glue along the bottom edges of the envelope and the securing strip hold the envelope together. Two tear lines provide for separation of the order blank and shipping label, removal of which places the envelope in condition for use.

5 Claims, 10 Drawing Figures

Fig. 6
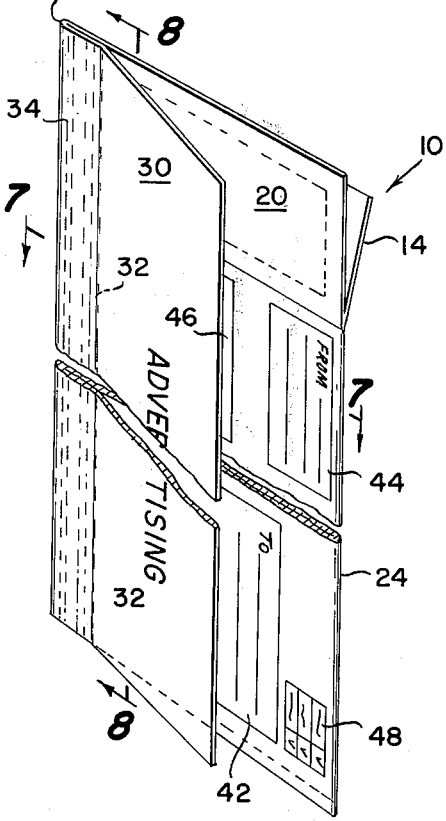
Fig. 7
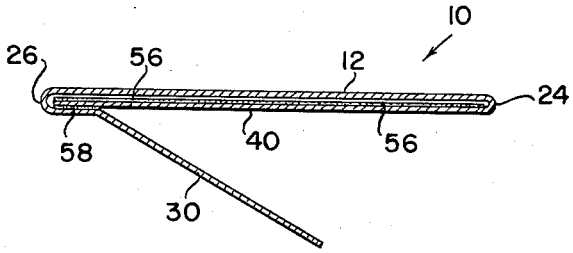
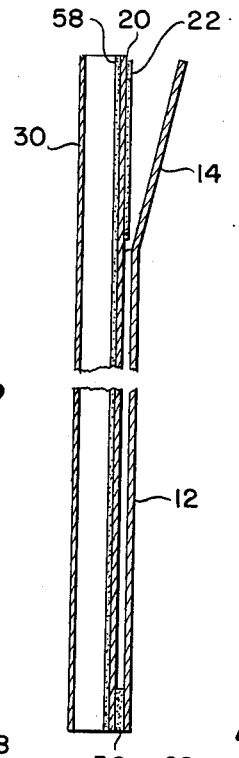
Fig. 8
Fig. 9
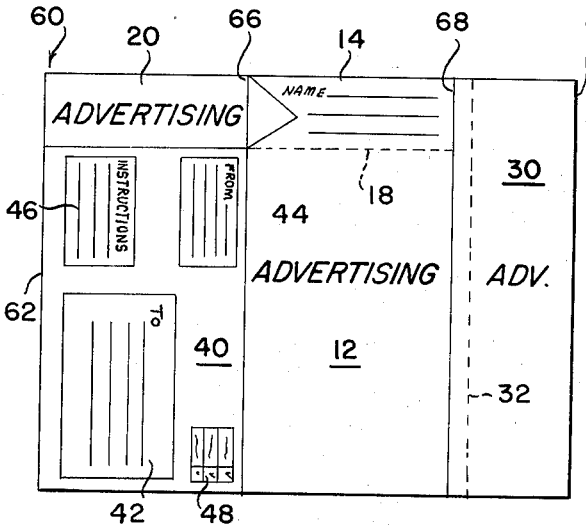
Fig. 10
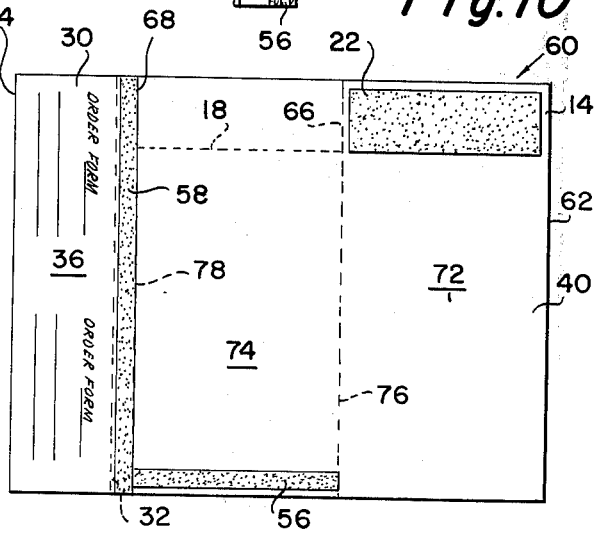

MAIL ORDER ENVELOPE ASSEMBLY

BACKGROUND OF INVENTION

This invention relates to a preprinted mail order envelope assembly used for mass distribution.

In recent years there has been much use of mass distributed mail return envelopes in which the customer places an order, material to be processed, and payment therefor. For example, the use of photo-mailer envelopes has been widespread within the last several years for the forwarding of film to photo processing laboratories.

One of the major reasons for success of such types of item has been the convenience and low price offered to the customer. In such items it is extremely important that maximum space be devoted to the advertising message, and this a big factor in the acceptance and use of the mass distributed mail order envelope.

For a widely distributed mail order item it is essential that the assembly provide a sturdy envelope, and an order blank and shipping label, as well as leaving open panels on which advertising can be placed. Heretofore, there has not been a mail order envelope assembly that has met these requirements.

SUMMARY OF INVENTION

Accordingly, this invention is directed to providing a mass distribution preprinted mail order envelope assembly meeting the above requirements.

The envelope assembly is self-contained, in that integral with it, both the required order blank form, and the return shipping label are integrally attached. Both are readily removable.

To provide for low cost of the assembly, the parts are arranged in a particular fashion so that the item can be manufactured on high speed printing and forming machinery. It is made from a single paper web, preprinted on high speed presses and fabricated with longitudinal feed web folding machinery.

The envelope is constructed to provide extra strength, with use of a folded longitudinal securing strip. The overall arrangement of the envelope elements, order blank form, and shipping label make it possible to use continuous high speed fabricating technique. They are also arranged so that multiple color printing of the advertising message can be employed on one side of the blank, and the fabricated mail order item will have the multi-color advertising message on the outside panels thereof.

DESCRIPTION OF THE DRAWINGS

FIG. 6 is a perspective view of the complete preprinted mail order envelope assembly in an upright position as viewed from the address side thereof, and showing the location of adhesive lines in dotted outline.

FIG. 7 is a cross sectional view along line 7—7 of FIG. 6.

FIG. 8 is a vertical section along line 8—8 of FIG. 6.

FIG. 9 is a plan view of the advertising side of a single section of the preprinted web prior to folding which shows the arrangement of the advertising and address sections.

FIG. 10 is a plan view of the inside face of a single section of the preprinted web prior to folding of the envelope and showing the positions of the glue sections and the perforate lines.

DESCRIPTION OF THE INVENTION

Figure 1:
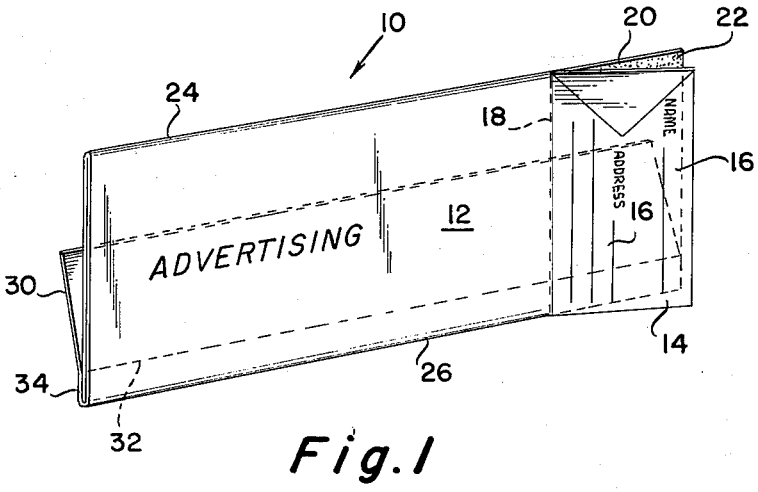
FIG. 1 is a perspective view of the preprinted mail order envelope assembly showing the large outside advertising panel.

Referring particularly to FIG. 1, the envelope assembly 10, has an outer envelope panel 12 containing advertising, with a shipping label 14 disposed immediately thereabove. Name and address blanks 16 are disposed on the outer side adjacent the advertising section, and the perforate line 18 provides for removal of the label.

The envelope flap 20 is disposed immediately behind the shipping label, and has a glue section 22 partially shown in FIG. 1 which faces the inner side of the shipping label 14.

Figure 2:
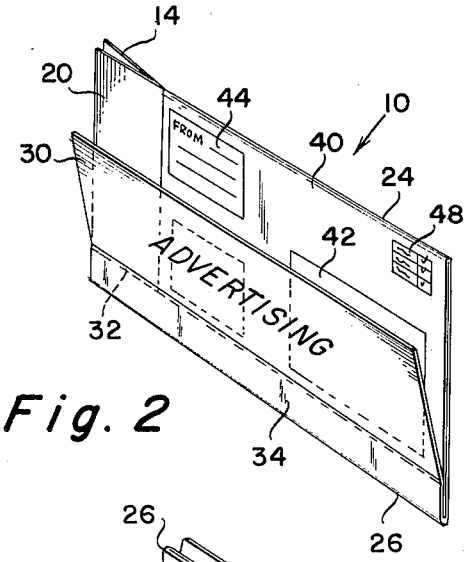
FIG. 2 is a smaller perspective view of the preprinted mail order envelope assembly showing the address side thereof, as well as a removable order form with advertising on its outer side.
Figure 3:
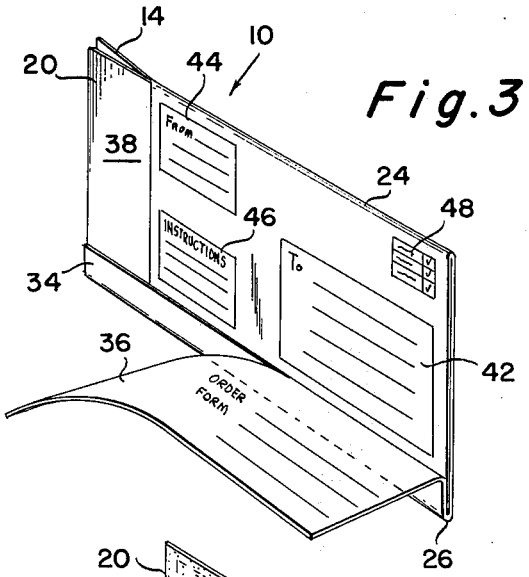
FIG. 3 is a perspective view similar to that of FIG. 2 in which the order form is partially removed.

The side edges of the envelope are formed along fold lines 24 and 26, as can be seen in FIGS. 2 and 3. These figures both show a perspective view of the envelope assembly from its other side. Advertising side 30 of the order coupon is shown in FIG. 2. It is removable along the perforate line 32 which defines the upper longitudinal edge of the envelope side edge closing strip 34.

FIG. 3 shows the order form partially removed. This is accomplished by tearing along the perforate line 32. The order form side 36 of the order form coupon is shown.

FIG. 3 shows the backside 38 of the envelope flap with the sealing strip extending to the upper edge of the flap.

In FIG. 3, the address panel for the envelope is fully shown. It has an address section 42, and a return address section 44, and an instruction secton 46. The stamp section 48 has information on required postage for different amounts, such as the number of photographic rolls, that would be inserted in the envelope.

In FIG. 3, it can be seen that the closing strip 34 extends the entire length of the envelope and extends over the back side 50 of the shipping label 14.

Figure 4:
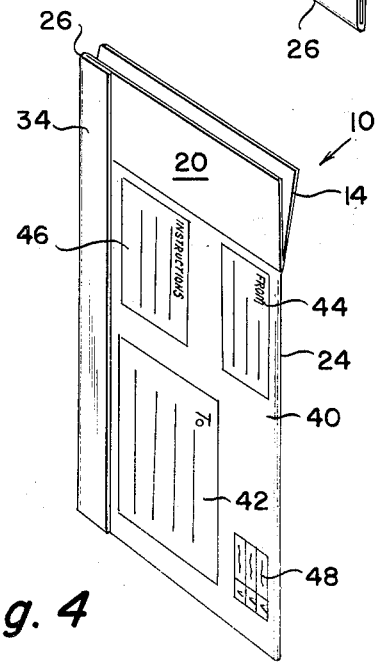
FIG. 4 is a perspective view of the envelope of FIG. 3 in an upright position after removal of the order form.

The view in FIG. 4 shows the envelope in a vertical position after removal of the order form, and prior to removal of the shipping label 14.

Figure 5:
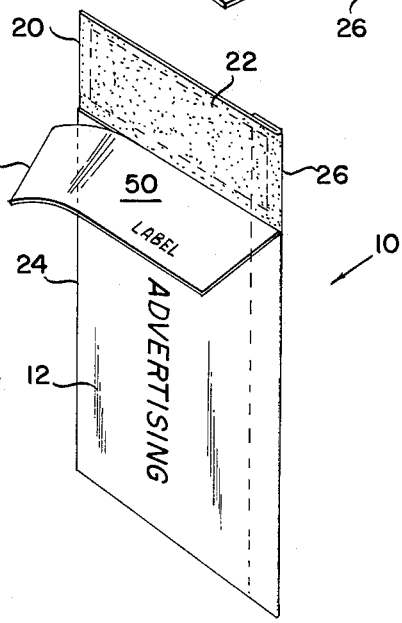
FIG. 5 is a perspective view of the upright envelope showing the advertising side with the shipping label partially removed.

FIG. 5 gives a perspective view of the upright envelope as viewed from the advertising side, and shows the shipping label 14, partially removed. The shading shows the pocket of the envelope. After removal of the shipping label, and insertion of the material to be forwarded, the glue section 22 of the envelope is moistened and the flap folded over and glued in position.

The upright perspective view of the envelope assembly shown in FIG. 6 is enlarged and shows in dotted outline the glue areas which are used to hold the assembly together. The three superposed panels, two of which are the envelope, and the third the order coupon, are formed from a single web by two lateral folds after application of glue strips to the previously printed web.

The longitudinal folding of the web from either side superposes the panels, and the glue sections hold the completed assembly together. In FIG. 6, the glue section 54 is shown at the bottom of the envelope and holds the two superposed sheets together.

The sectional view shown in FIG. 7 shows the glue strip between the advertising panel 12 and the address panel 40 of the envelope.

A sectional view of the glue strip 58 under the envelope side edge closing strip 34 is also shown in FIGS. 7 and 8.

The envelope flap glue section 22 is shown in dotted outline in FIG. 6 and in section in FIG. 8.

FIG. 9 shows the envelope assembly blank 60 prior to folding. Note that the various sections and panels are arranged such that this side of the blank will contain all of the advertising printing so that all of the multi-colored print can be placed on one side of the web. The sides of the webs are shown at 62 and 64, and the web has a continuous series of repeat patterns as shown in FIG. 9, with the continuous web running in a longitudinal direction through the presses and the fabricating machinery.

The perforate line 32 for the order coupon 30 and the perforate line 18 for the shipping label are shown on the blank. In addition, cuts are made in the blank at 66 and 68 in line with and above the side edge fold lines 24 and 26 to be made furing the folding operation, to provide separate unattached arrangement of the shipping label and the envelope flap after the folding operation is completed.

The stock for the preprinted mail order assembly is a large roll of paper web which is first run through the preprinting rolls where several colored runs are made on the advertising side to print the blanks of FIG. 9. The width of the web is from edge 62 to 64. The continuous printed web is then run through a glue roller assembly which applies glue strips to the other side of the web as shown in FIG. 10.

With reference to FIG. 10, the plain inner side 70 of the envelope assembly blank is shown and the arrangement and location of the glue lines 22, 56 and 58 is illustrated. These glue lines are applied by glue applicating rollers. One roller applies the continuous glue line 58 of FIG. 10 that extends continuously along the web from one blank to another in a longitudinal direction. Separate applicator rollers apply the envelope sealing glue line 56, and the envelope flap glue line 22.

The slits 66 and 68 are made by intermittent cutters, while a longitudinal perforator makes the order blank perforation line 32, and a cross perforator makes perforation line 18 for the removal of the shipping label 14 to complete preparation of the flat blank prior to folding.

The blanks are then laterally folded, with the lateral folding of the inner side 72 of the envelope order panel 40 over onto the inner face 74 of the advertising panel 12 along dashed line 76, placing the envelope panels in superposed relation to one another.

The second lateral fold, along the dashed line 78, places the order blank face 36 and the glue containing face 80 of securing strip 34 over on top of the outer side of the previously folded blank section 72 to complete the folding operation. Subsequent transverse severing of successive sections of the web completes the manufacture of the items. Katz patents U.S. Pat. Nos. 3,743,273, 3,665,817, and 3,784,185 show glue applying apparatus, perforator, slitting, folding, and transverse slitting in the manufacture of continuous web preprinted items.

It can be appreciated that this type of continuous printing, gluing, perforating, and folding, followed by continuous transverse severing of the strip permits these assemblies to be made both quickly and economically.

With the savings in manufacture, as well as the ample provision of advertising space on the finished article, the mail order envelope assembly provides a new, low cost, and effective item to be used by the mail order industry.

While this invention has been described, it will be understood that it is capable of further modification, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A pre-printed mail order envelope assembly, comprising:

a. a single pre-printed elongated sheet folded along two parallel fold lines to give three superposed rectangular panels, both ends of each panel being in registry with the corresponding ends of the other panels, b. a major portion of the intermediate panel and the opposed portion of one outside panel, forming opposed, elongated envelope sections which extend from one end of the pre-printed sheet and which are of the same width, c. a strip of adhesive disposed between said opposed envelope sections adjacent and parallel to their one end and joining them together to form the bottom of an envelope, d. the two parallel fold lines forming elongated side edges of the envelope, e. the remaining part of one of the panels having an envelope section being an envelope flap to which glue has been applied, f. the remaining part of the other of the panels having an envelope section being an address coupon which is separated from its envelope section by a transverse perforate line, g. the envelope flap and the address coupon being separated from each other along two slits which extend from and are in alignment with the two parallel fold lines, h. a glue strip disposed between the intermediate and the other outside panel adjacent one of said fold lines, said fold line connecting the two outside panels together, said glue strip joining said other outside panel and said intermediate panel together along that side, i. the third panel being a coupon which is separable from the envelope along a perforate line extending parallel and adjacent to the glue strip for the entire length of said other outside panel, j. the glue strips being applied to the surface of the single pre-printed sheet such that they are disposed on only one side thereof prior to folding, k. the outside surfaces of the two outer panels containing printed advertising material.

2. The pre-printed mail order envelope assembly as set forth in claim 1, wherein:

a. all the glue strips are applied to the inside facing surfaces of the panels, b. the outside facing surfaces of the panels contain multi-colored advertising material.

3. The pre-printed mail order envelope assembly as set forth in claim 1, wherein:

a. the order blank has multi-colored advertising on its outside face, and a one color printing order blank on its inner face, b. the envelope secton facing the order blank panel has return address, mailing and postage information, and c. the other envelope section on its outer face has multi-colored advertising material.

4. The pre-printed mail order envelope assembly as set forth in claim 1, wherein:

a. all the glue strips are applied to the inside facing surfaces of the panels, b. only the outside facing surfaces of the panels contain multi-colored advertising material, c. postage information is printed on the envelope in the stamp receiving section to which postage is to be affixed.

5. The pre-printed mail order envelope assembly as set forth in claim 1, wherein:

a. the order blank has multi-colored advertising on its outside face, and price and order information and information receiving blanks on its inner face, b. the envelope section facing the order blank panel has printed return address, mailing, and postage information sections, c. the other envelope section has on its outer face multi-colored advertising material, and d. the outside surface of the shipping label is multi-colored to attract attention and has spaces for return address information.

* * * * *